US005228685A

United States Patent [19]

Williamson

[11] Patent Number: 5,228,685

[45] Date of Patent: Jul. 20, 1993

[54] KIT FOR MAKING LINED PUTTING HOLE ASSEMBLY

[76] Inventor: Stanley Williamson, 6 Oakhill Road, Beckenham Kent BR3 2NQ, United Kingdom

[21] Appl. No.: 848,947

[22] PCT Filed: Aug. 15, 1990

[86] PCT No.: PCT/GB90/01290

§ 371 Date: Apr. 15, 1992

§ 102(e) Date: Apr. 15, 1992

[87] PCT Pub. No.: WO91/02569

PCT Pub. Date: Mar. 7, 1991

[30] Foreign Application Priority Data

Aug. 15, 1989 [GB] United Kingdom ..... 8918576

[51] Int. Cl.[5] ..... A63B 57/00; A01B 45/00; A01C 11/00; A01D 9/06

[52] U.S. Cl. ..... 273/34 B; 172/19; 172/22; 30/278

[58] Field of Search ..... 30/278, 297; 172/19, 172/20, 21, 22; 273/34 R, 34 B, 34 A

[56] References Cited

U.S. PATENT DOCUMENTS

| | | | |
|---|---|---|---|
| 947,819 | 2/1910 | Hinckley | 273/34 R |
| 1,866,073 | 7/1932 | Aberle | 172/22 X |
| 4,280,698 | 7/1981 | Troiano | 273/34 B |
| 4,585,072 | 4/1986 | Martinez | 172/22 |

*Primary Examiner*—George J. Marlo
*Attorney, Agent, or Firm*—Edwin D. Schindler

[57] ABSTRACT

A kit for making a lined putting hole includes a circular cup and an elongated handle including an apertured plate which engages projections on the bottom of the inverted cup for enabling the cup's chamfered upper rim to be used to cut a circular hole in the ground. The handle is made to be detachable from the cup so that the cup can be placed in the hole to form a liner. The bottom of the cup is formed to mount a flag when it is being used as a liner.

9 Claims, 4 Drawing Sheets

KIT FOR MAKING LINED PUTTING HOLE ASSEMBLY

This invention relates to a golf putting kit.

In accordance with this invention, there is provided a putting kit which comprises a circular cup, and a handle for fitting to the bottom of the upturned cup to enable the cup to be used to cut a circular hole in the ground, the handle being detachable from the cup so that the cup can be placed in the hole to form a liner.

Preferably the bottom of the cup is formed so as to mount an upright flag or marker when being used as a liner.

The cup preferably comprises a one-piece plastics injection moulding. The handle preferably has a plate at its lower end, formed with apertures to fit over dogs projecting from the bottom of the cup. Preferably the cup is formed with a central aperture and the handle is formed with an internal thread at its lower end, so that a bolt may be fastened into the end of the handle through the bottom of the cup to fix the cup to the handle: this is necessary so that the cup can be pulled out of the ground once it has cut a hole. The cup will withdraw with it a plug of turf which can now be discarded before the cup is removed from the handle and placed in the hole as a liner.

An embodiment of this invention will now be described by way of example only and with reference to the accompanying drawings, in which.

Figure 1:
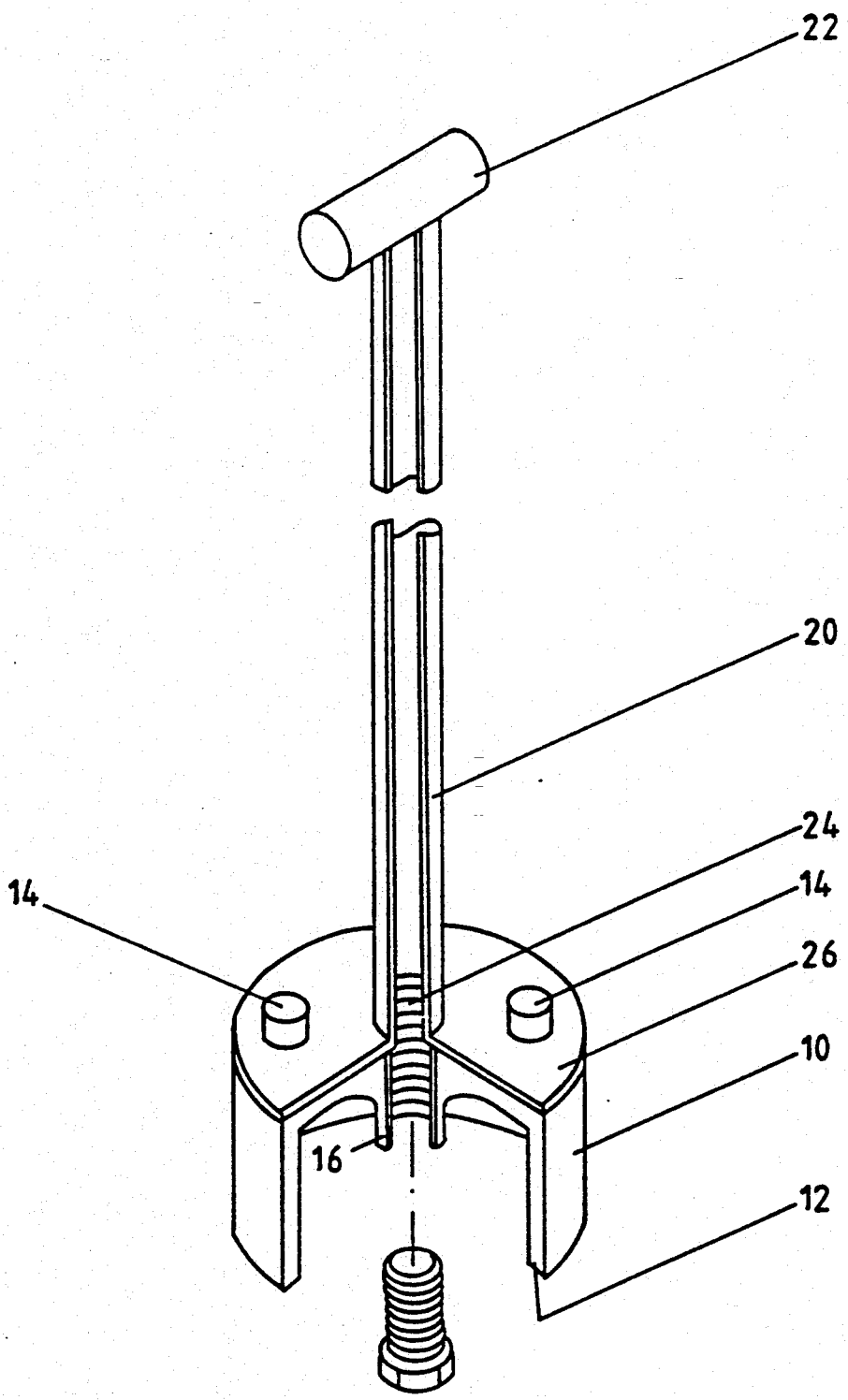
FIG. 1 is a view, partly broken away of a cup fitted to a handle of the golf putting kit.
Figure 2:
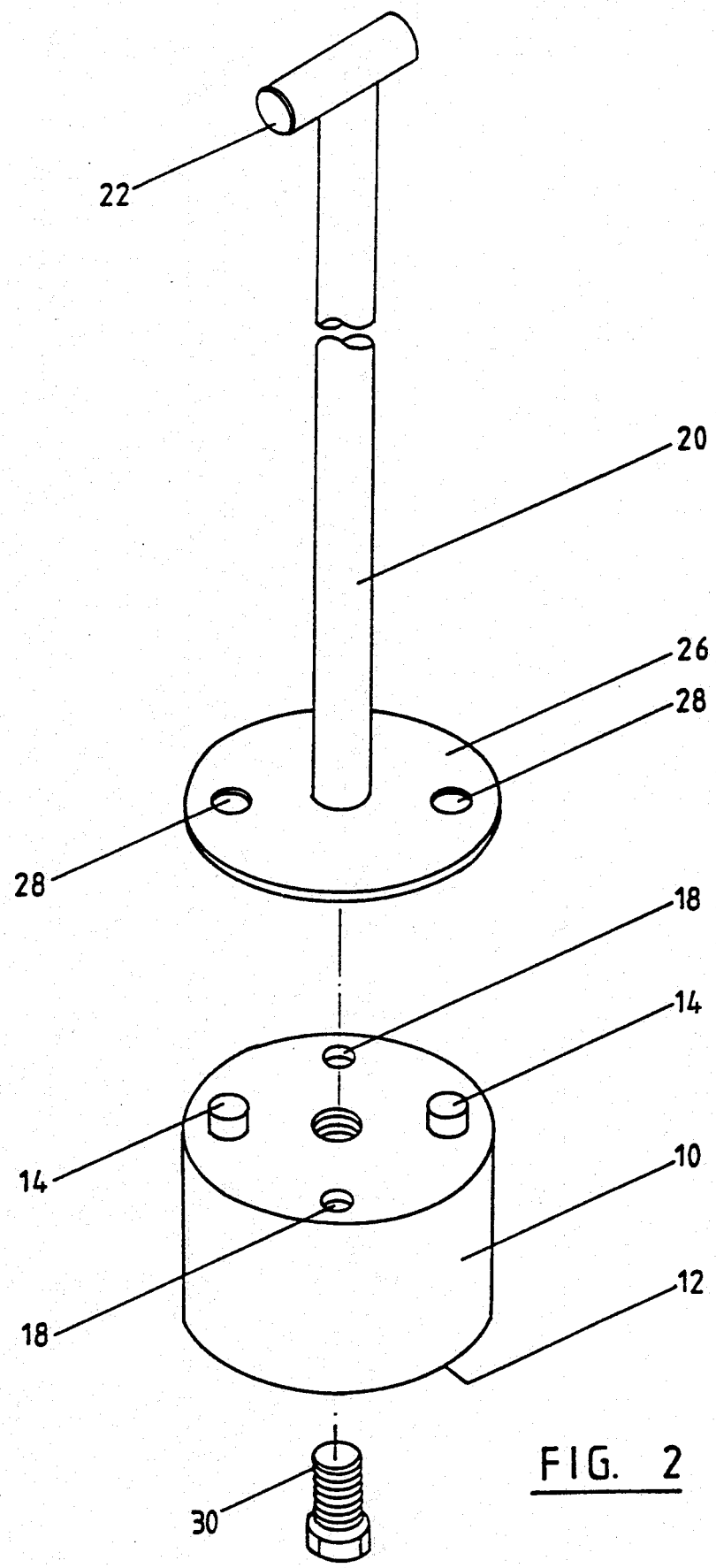
FIG. 2 is a view of the handle and cup when separated.

Referring to FIGS. 1 and 2, there is shown a golf putting kit comprising a circular cup 10 with a chamfered rim 12. The bottom surface of the cup is formed with a pair of projecting dogs 14 and the inside bottom of the cup is formed with an apertured boss 16. The cup preferably comprises a one-piece plastics injection moulding.

The kit shown in FIG. 1 also includes a handle having a stem 20 and a cross-piece 22. The lower end of the stem 20 of the handle is formed with an internal screw thread 24, and a circular plate 26 is fixed to this lower end of the handle and is formed with two circular apertures 28. The handle is preferably formed from metal.

The plate 26 fits against the flat bottom of the upturned cup 10 with the projecting dogs 14 on the bottom of the cup received within the apertures 28 in the plate. Also, a bolt 30 is inserted through the bore in the boss 16 and into the threaded lower end of the stem 20 of the handle and tightened to hold the cup to the handle. The assembly can then be used to cut a circular hole in the turf, by resting the chamfered rim of the cup 10 on the ground and then turning the cup by means of the handle. When the cup has cut into the turf a depth corresponding to its own height, it is pulled from the ground by means of the handle, pulling with it a plug of turf within the cup. This plug of turf can now be discarded. Further, the bolt 30 can be loosened and the cup removed from the handle, so that the cup can be used as a liner in t he hole which it has cut in the turf.

Figure 3:
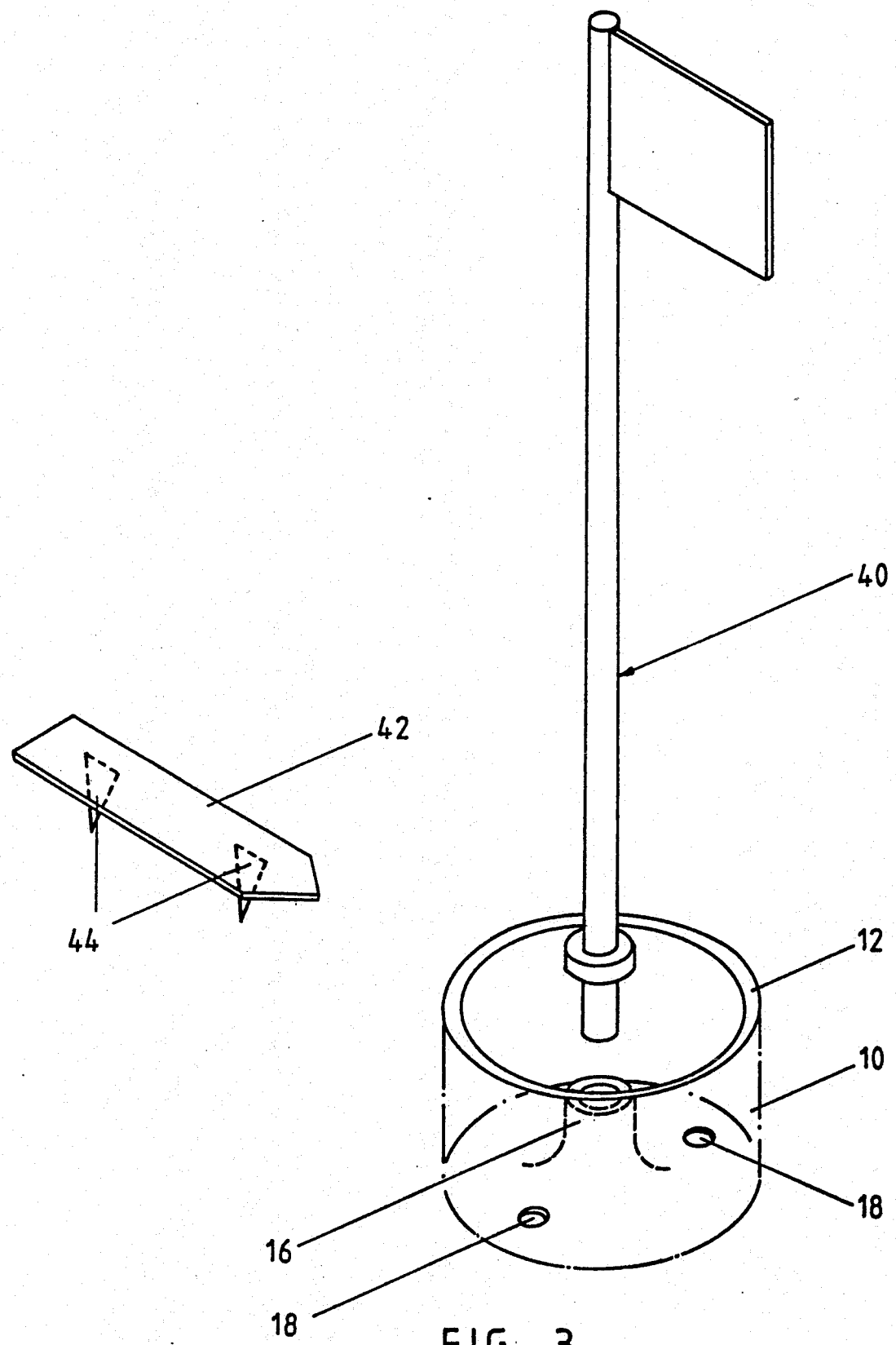
FIG. 3 is a view showing use of the cup as a liner and fitted with a flag or marker.

This use of the cup as a liner is shown in FIG. 3. Preferably the bottom of the cup is further formed with drain holes 18. Also shown in FIG. 3 is a flag or marker 10 attached to an upright stem which is inserted at its lower end into the apertured boss 16 of the cup. The kit may further comprise a flat arrow or pointer 42 formed with spikes 44 on its underside, for pressing into the turf so that the pointer 42 will indicate the hole.

Figure 4:
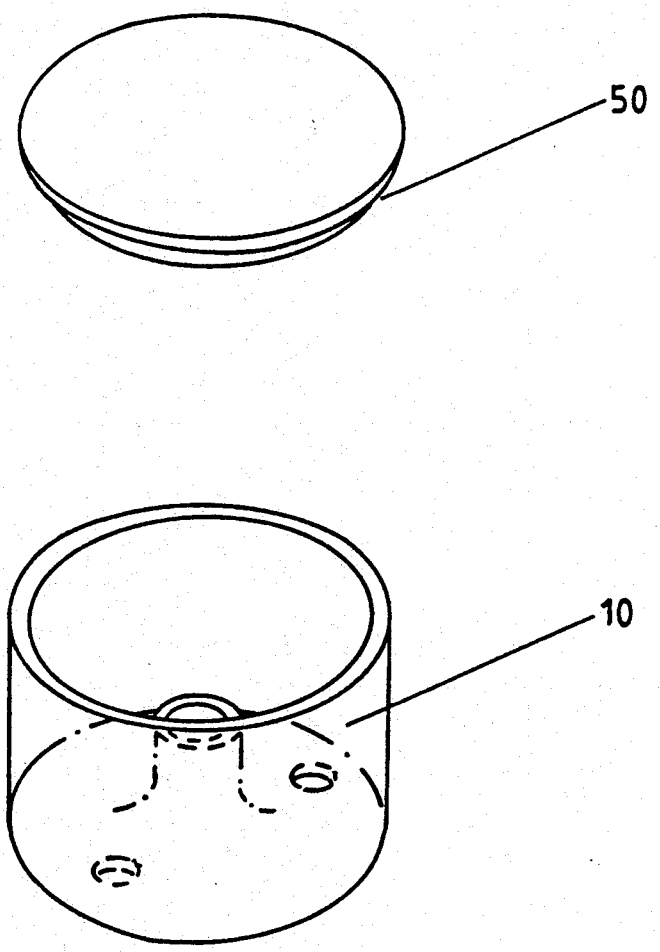
FIG. 4 is a view of the cup and of a plug to close the cup when not in use.

When the cup is installed but not in use, it may be closed by means of a circular plastics cover or plug 50 as shown in FIG. 4.

I claim:

1. A kit for making a lined putting hole comprising:
   a circular cup having a substantially open interior, an upper rim, and a generally closed bottom;
   means for cutting a circular hole in golf putting grounds, said means for cutting being provided as a chamfered upper rim of said circular cup;
   an elongated handle; means for securing said handle to the outer side of said bottom for enabling said chamfered rim to cut said circular hole when said circular cup is positioned with said bottom uppermost, said bottom including outward extending projections, and said handle including a lower end having a plate formed with apertures therein for fitting over said projections on the bottom of said cup; and
   means for detecting said handle from said bottom so that after cutting said hole said circular cup may be placed into said circular hole with its bottoms lowermost to form a liner for said hole.

2. The putting kit according to claim 1, wherein said circular cup includes means for mounting an upright marker when the cup is being used as a liner.

3. The putting kit according to claim 1, wherein said circular cup is formed as a one-piece plastic injection molding. handle includes a lower end having a plate formed with apertures therein for fitting over said projections on the bottom of said circular cup when said circular cup is upturned.

4. The putting kit according to claim 1, wherein said circular cup is formed with a central aperture.

5. The putting kit according to claim 4, further comprising a bolt being capable of fastening into a lower end of said handle through said aperture for fixing said circular cup to said handle.

6. The putting kit according to claim 1, wherein said bottom is provided with an aperture and said handle is provided with an internal screw-thread at a lower end so that a bolt is able to be fastened into the end of said handle through said aperture in the bottom of said circular cup for fixing said circular cup to said handle thereby allowing said circular cup to be pulled from the golf putting grounds once the circular hole has been cut.

7. The putting kit according to claim 1, further comprising an upright marker being removably attachable within said circular cup.

8. The putting kit according to claim 1, further comprising a flat pointer having spikes on its underside for pressing said flat point into the golf putting grounds.

9. The putting kit according to claim 1, further comprising a circular plastic cover for closing said circular cup when said circular cup is used as a liner.

* * * * *